US005991928A

United States Patent [19]

Smith et al.

[11] Patent Number: 5,991,928

[45] Date of Patent: Nov. 30, 1999

[54] BUCKLE GUARD AND GARMENT LAUNDERING METHOD

[76] Inventors: Rebecca G. Smith; Bryan E. Smith, both of 13785 Belleterre Dr., Alpharetta, Ga. 30004

[21] Appl. No.: 09/055,864

[22] Filed: Apr. 6, 1998

[51] Int. Cl.[6] ..... A41D 27/12

[52] U.S. Cl. ..... 2/300; 2/340; 2/46; 24/DIG. 29

[58] Field of Search ..... 2/300, 336, 340, 2/342, 338, 60, 46, 265, 266; 223/84, DIG. 2; 24/DIG. 29, 90.5, 184, 185

[56] References Cited

U.S. PATENT DOCUMENTS

| | | | |
|---|---|---|---|
| D. 301,084 | 5/1989 | Mathews | D2/639 |
| D. 307,512 | 5/1990 | Woods | D2/639 |
| 617,085 | 1/1899 | Edgarton | 2/342 |
| 679,994 | 8/1901 | Sawyer | 2/342 |
| 738,081 | 9/1903 | Spencer | 2/342 |
| 1,263,446 | 4/1918 | Logan | 2/60 |
| 1,842,726 | 1/1932 | Luce | 2/300 |
| 2,891,254 | 6/1959 | Stollman | 2/321 |
| 3,616,498 | 11/1971 | Rosenthal | 24/90.5 |
| 3,934,848 | 1/1976 | Snyder | 24/197 |
| 4,715,839 | 12/1987 | Ford et al. | 446/28 |
| 5,044,012 | 9/1991 | Antonino | 2/46 |
| 5,054,128 | 10/1991 | Wimmer | 2/300 |
| 5,483,704 | 1/1996 | Filipiak | 2/336 |
| 5,769,288 | 6/1998 | Berglund | 223/84 |

*Primary Examiner*—Amy Vanatta
*Attorney, Agent, or Firm*—Joseph N. Breaux

[57] ABSTRACT

A buckle guard that includes a flexible buckle guard member with a fastening button opening, a first hook and pile fastener section adjacent to the fastening button opening, and a second companionate hook and pile fastener section provided along an opposed side edge of the flexible guard member; and a garment laundering method includes the steps of (1) providing one buckle guard for each buckle assembly on the garment that includes a fastening button member stitched to a first strap section and a clip fastener member pivotally secured to a second strap member, the clip fastener member including a fastening button passage portion in connection with a semi-circular retaining ring portion; (2) installing each of the buckle guards over a buckle assembly by positioning the fastening button member through the fastening button opening of the flexible buckle guard member and into the semi-circular retaining ring of the clip fastener member and then folding the flexible buckle guard member over until the first and second hook and pile sections are secured together through the fastening button passage portion of the clip fastener member; and then (3) laundering the garment.

1 Claim, 2 Drawing Sheets

BUCKLE GUARD AND GARMENT LAUNDERING METHOD

TECHNICAL FIELD

The present invention relates to devices and methods for preventing damage to the buckles of garments during laundering and more particularly to a buckle guard and a laundering method using the buckle guard wherein the buckle guard includes a flexible buckle guard member with a fastening button opening, a first hook and pile fastener section adjacent to the fastening button opening, and a second companionate hook and pile fastener section provided along an opposed side edge of the flexible guard member; and wherein the garment laundering method includes the steps of (1) providing one buckle guard for each buckle assembly on the garment that includes a fastening button member stitched to a first strap section and a clip fastener member pivotally secured to a second strap member, the clip fastener member including a fastening button passage portion in connection with a semi-circular retaining ring portion; (2) installing each of the buckle guards over a buckle assembly by positioning the fastening button member through the fastening button opening of the flexible buckle guard member and into the semi-circular retaining ring of the clip fastener member and then folding the flexible buckle guard member over until the first and second hook and pile sections are secured together through the fastening button passage portion of the clip fastener member; and then (3) laundering the garment.

BACKGROUND ART

The buckle assemblies of garments such as overalls can become damaged during the laundering process and can damage the interiors of washing machines and dryers. It would be a benefit, therefore, to have a buckle guard that could be positioned over the buckle assembly to protect it and the laundering equipment during laundering. It would also be a benefit to have a laundering method that included the step of positioning a buckle guard over each buckle assembly of a garment prior to laundering the garment.

GENERAL SUMMARY DISCUSSION OF INVENTION

It is thus an object of the invention to provide a buckle guard for shielding a buckle assembly of a garment during laundering.

It is a further object of the invention to provide a buckle guard that includes a flexible buckle guard member with a fastening button opening, a first hook and pile fastener section adjacent to the fastening button opening, and a second companionate hook and pile fastener section provided along an opposed side edge of the flexible guard member.

It is a still further object of the invention to provide a garment laundering method that includes the steps of (1) providing one buckle guard for each buckle assembly on the garment that includes a fastening button member stitched to a first strap section and a clip fastener member pivotally secured to a second strap member, the clip fastener member including a fastening button passage portion in connection with a semi-circular retaining ring portion; (2) installing each of the buckle guards over a buckle assembly by positioning the fastening button member through the fastening button opening of the flexible buckle guard member and into the semi-circular retaining ring of the clip fastener member and then folding the flexible buckle guard member over until the first and second hook and pile sections are secured together through the fastening button passage portion of the clip fastener member; and then (3) laundering the garment.

Accordingly, in a first aspect of the invention buckle guard is provided. The buckle guard includes a flexible buckle guard member with a fastening button opening, a first hook and pile fastener section adjacent to the fastening button opening, and a second companionate hook and pile fastener section provided along an opposed side edge of the flexible guard member. If desired the entire perimeter edge of the flexible guard member can be provided with companionate sections of hook and pile fastener such that a buckle cavity is formed by folding the flexible guard member in half.

In a second aspect of the invention a garment laundering method is provided. The garment laundering method comprises the steps of (1) providing one buckle guard for each buckle assembly on the garment that includes a fastening button member stitched to a first strap section and a clip fastener member pivotally secured to a second strap member, the clip fastener member including a fastening button passage portion in connection with a semi-circular retaining ring portion; (2) installing each of the buckle guards over a buckle assembly by positioning the fastening button member through the fastening button opening of the flexible buckle guard member and into the semi-circular retaining ring of the clip fastener member and then folding the flexible buckle guard member over until the first and second hook and pile sections are secured together through the fastening button passage portion of the clip fastener member; and then (3) laundering the garment.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
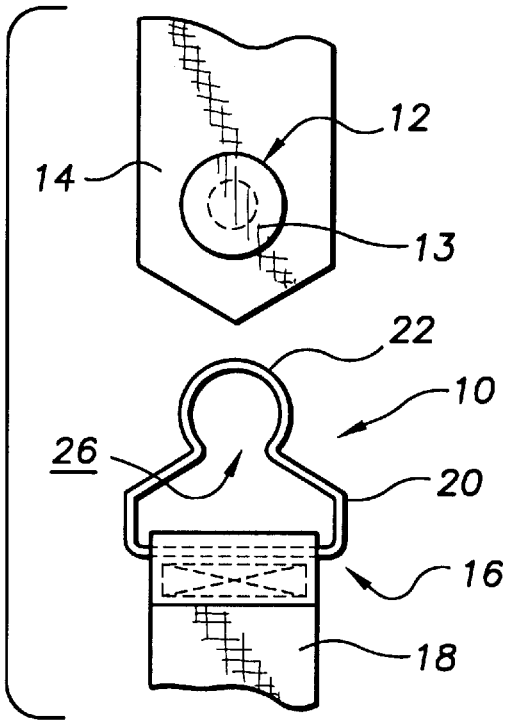
FIG. 1 is a front plan view of an exemplary overall buckle assembly representative of the buckles with which the buckle guard and garment laundering method of the present invention are used showing the fastening button member stitched to a first strap section and the clip fastener member pivotally secured to a second strap member, the clip fastener member including a fastening button passage portion in connection with a semi-circular retaining ring portion.
Figure 3:
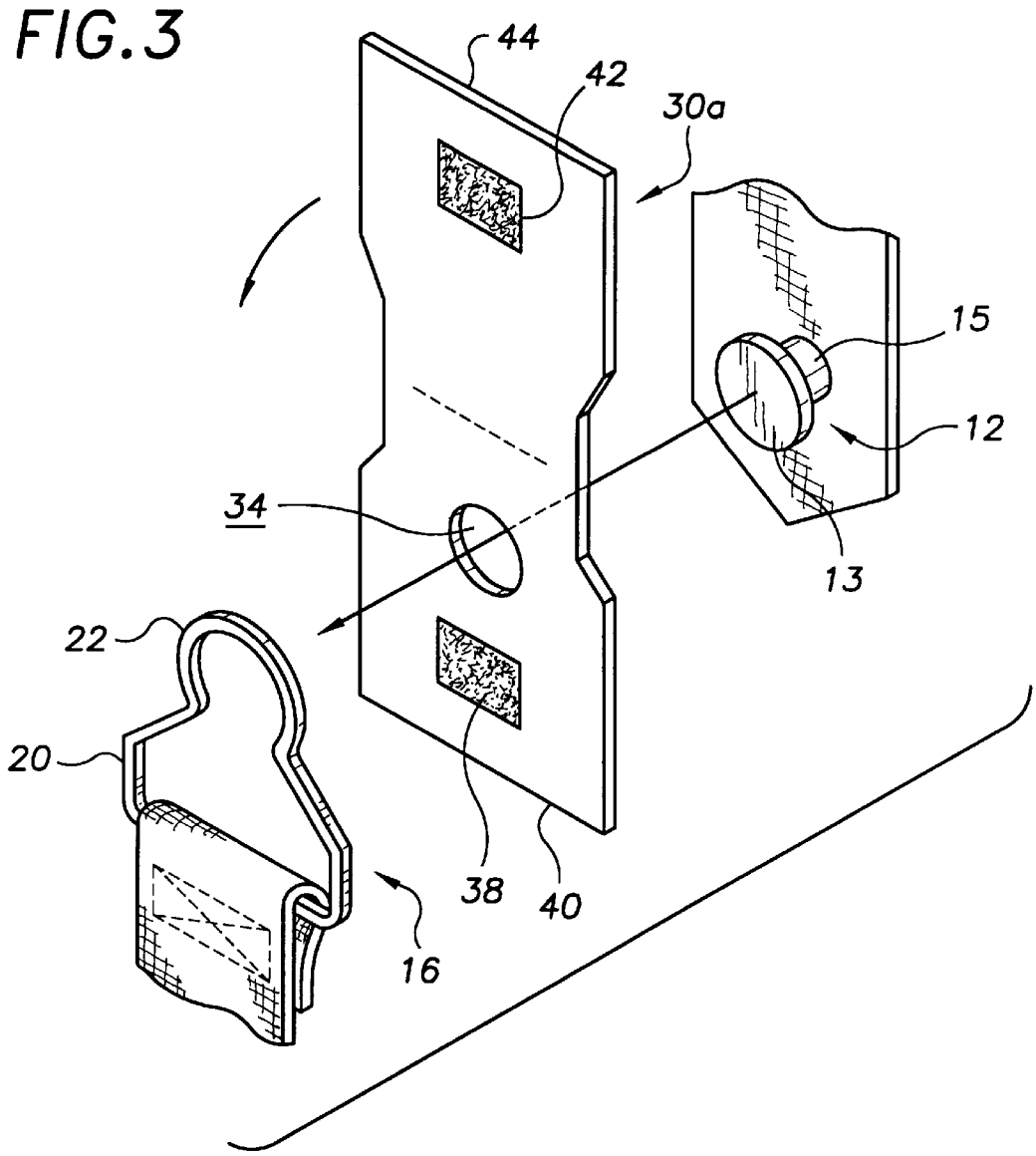
FIG. 3 is an exploded perspective view showing positioning of the fastening button member through the fastening button opening of a second embodiment of the flexible buckle guard member, through the fastening button passage portion of the clip fastener member and then laterally into the semi-circular retaining ring of the clip fastener member, the second embodiment of the flexible guard member being identical to the first embodiment except that in the second embodiment of the flexible guard member the top and lower hook and pile edge sections are omitted.
Figure 4:
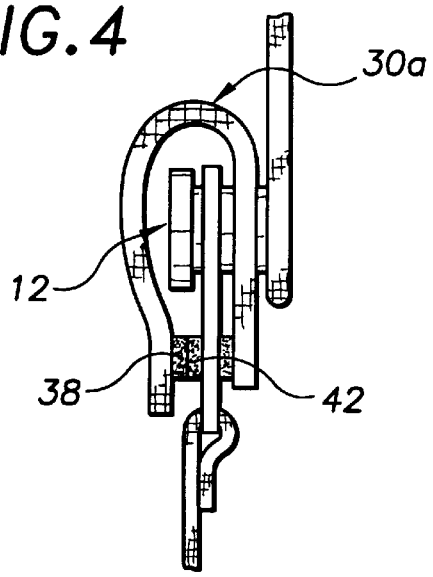
FIG. 4 is a side plan view showing the buckle guard of FIG. 3 installed over the overall buckle assembly of FIG. 1 with the fastening button member positioned through the fastening button opening of the flexible buckle guard member and into the semi-circular retaining ring of the clip fastener member; and the flexible buckle guard member folded over with the first and second hook and pile sections secured together through the fastening button passage portion of the clip fastener member.

FIG. 1 shows an exemplary overall buckle assembly, generally designated by the numeral 10. Buckle assembly 10 is representative the buckles with which the buckle guard and garment laundering method of the present invention are used. Buckle assembly 10 includes a fastening button member, generally designated 12, including a cap portion 13 and a shaft portion 15 (FIG. 3) that is stitched to a first strap section 14; and a clip fastener member, generally designated 16, that is pivotally secured to a second strap member 18. In this embodiment, clip fastener member 16 is of bent metal construction and includes a fastening button passage portion 20 that is in connection with a semi-circular retaining ring portion 22. The diameter of retaining ring portion 22 is less than the diameter of the cap portion 13. A lateral insertion opening 26 connects fastening button passage portion 20 with semi-circular retaining ring portion 22. Lateral insertion opening 26 has a width less than the diameter of shaft portion 15 (FIG. 3) but can be resiliently expanded to allow insertion of shaft portion 15 therethrough.

Figure 2:
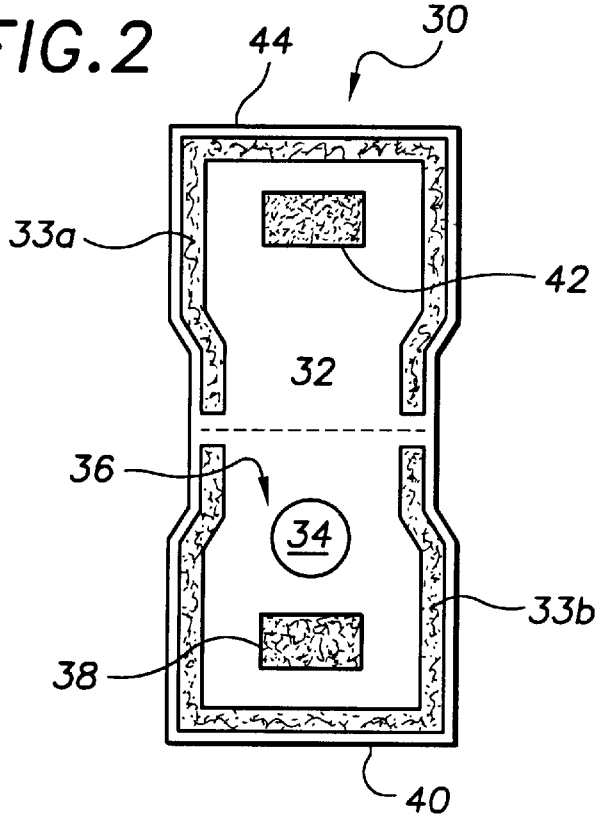
FIG. 2 is a plan view of a first exemplary embodiment of the buckle guard of the present invention showing the flexible buckle guard member with the circular fastening button opening, the first hook and pile fastener section adjacent to the fastening button opening, the second hook and pile fastener section provided along an opposed side edge, the top hook and pile edge sections formed around the top edges of the flexible guard member, and the lower hook and pile edge sections formed around the lower edges of the flexible guard member .

FIG. 2 shows a first exemplary embodiment of the buckle guard of the present invention, generally designated by the numeral 30. In this embodiment, buckle guard 30 includes a substantially rectangular flexible fabric buckle guard member 32 having a circular fastening button opening 34 provided in a lower portion 36 hereof. Circular fastening button opening 34 is sized to allow passage therethrough of cap portion 13 (FIG. 1). A first hook and pile fastener section 38 is stitched to fabric buckle guard member 32 adjacent to fastening button opening 34 and a first side edge 40. A second, companionate hook and pile fastener section 42 is stitched to fabric buckle guard member 32 adjacent to a second side edge 44. Top hook and pile edge sections 33*a* are provided around the top edges of buckle guard member 32. Lower hook and pile edge sections 33*b* are provided around the lower edges of buckle guard member 32.

The garment laundering method is now described with reference to FIGS. 1–4. The laundering method includes the step of providing one buckle guard 30*a* (FIG. 3) for each buckle assembly 10 on the garment to be laundered; (2) installing each of the buckle guards 30*a* (FIG. 3) over a buckle assembly 10 by positioning fastening button member 12 through fastening button opening 34 of flexible buckle guard member 30*a* and into the semi-circular retaining ring 22 of clip fastener member 16 and then folding flexible buckle guard member 30 over until first and second hook and pile sections 38,42 are secured together through fastening button passage portion 20 of the clip fastener member 16; and then (3) laundering the garment. Buckle guard 30*a* is identical to buckle guard 30 except top and lower hook and pile edge sections 33*a*,33*b* are omitted.

It can be seen from the preceding description that a buckle guard has been provided that includes a flexible buckle guard member with a fastening button opening, a first hook and pile fastener section adjacent to the fastening button opening, and a second companionate hook and pile fastener section provided along an opposed side edge of the flexible guard member. It can further be seen that a garment laundering method has been provided that includes the steps of (1) providing one buckle guard for each buckle assembly on the garment that includes a fastening button member stitched to a first strap section and a clip fastener member pivotally secured to a second strap member, the clip fastener member including a fastening button passage portion in connection with a semi-circular retaining ring portion; (2) installing each of the buckle guards over a buckle assembly by positioning the fastening button member through the fastening button opening of the flexible buckle guard member and into the semi-circular retaining ring of the clip fastener member and then folding the flexible buckle guard member over until the first and second hook and pile sections are secured together through the fastening button passage portion of the clip fastener member; and then (3) laundering the garment.

It is noted that the embodiment of the buckle guard and the garment laundering method described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A garment laundering method for laundering a garment that includes at least one buckle assembly including a fastening button member stitched to a first strap section and a clip fastener member pivotally secured to a second strap member, the clip fastener member including a fastening button passage portion in connection with a semi-circular retaining ring portion, said garment laundering method comprising the steps of:

(a) providing one buckle guard for each buckle assembly on the garment, each buckle guard including a flexible buckle guard member with a fastening button opening, a first hook and pile fastener section adjacent to said fastening button opening, and a second companionate hook and pile fastener section provided along an opposed side edge of said flexible guard member;

(b) installing each of said buckle guards over a buckle assembly by positioning the fastening button member through said fastening button opening of said flexible buckle guard member and into the semi-circular retaining ring of the clip fastener member and then folding said flexible buckle guard member over until said first and second hook and pile sections are secured together through the fastening button passage portion of the clip fastener member; and then (c) laundering the garment.

* * * * *